US007895775B2

(12) United States Patent
Tack

(10) Patent No.: US 7,895,775 B2
(45) Date of Patent: Mar. 1, 2011

(54) DRAGHEAD FOR A TRAILING SUCTION HOPPER AND PROCESS FOR DREDGING BY MEANS OF THIS DRAGHEAD

(75) Inventor: Bruno Tack, Assenede (BE)

(73) Assignee: Dredging International, Zwijndrecht (BE)

( * ) Notice: Subject to any disclaimer, the term of this patent is extended or adjusted under 35 U.S.C. 154(b) by 0 days.

(21) Appl. No.: 11/569,639

(22) PCT Filed: Aug. 30, 2005

(86) PCT No.: PCT/EP2005/054262

§ 371 (c)(1),
(2), (4) Date: Nov. 27, 2006

(87) PCT Pub. No.: WO2006/027325

PCT Pub. Date: Mar. 16, 2006

(65) Prior Publication Data

US 2007/0261275 A1 Nov. 15, 2007

(30) Foreign Application Priority Data

Sep. 10, 2004 (BE) ..... 2004/0443

(51) Int. Cl.
*E02F 3/88* (2006.01)

(52) U.S. Cl. ..... 37/317; 37/333; 37/335; 37/342; 37/344; 37/323

(58) Field of Classification Search ..... 37/307, 37/317, 333, 335, 342, 344, 316, 322, 323
See application file for complete search history.

(56) References Cited

U.S. PATENT DOCUMENTS 1,705,428 A * 3/1929 Twiford ..... 37/325
1,729,054 A * 9/1929 Shotwell ..... 37/333
1,840,606 A * 1/1932 Scheffauer ..... 37/333
1,939,389 A * 12/1933 Condron ..... 37/333
3,305,950 A * 2/1967 Hirshman et al. ..... 37/311
3,412,862 A * 11/1968 Chaplin ..... 210/768
4,123,859 A * 11/1978 de Koning ..... 37/325
4,150,502 A * 4/1979 Sijthoff ..... 37/333
4,249,324 A * 2/1981 Latimer ..... 37/325
4,265,035 A * 5/1981 Goedvolk ..... 37/333
4,597,200 A * 7/1986 van der Meer et al. ..... 37/336
5,603,171 A * 2/1997 Steinkuhler ..... 37/195

(Continued)

FOREIGN PATENT DOCUMENTS

GB 1 383 089 2/1975

(Continued)

*Primary Examiner*—Thomas A Beach
*Assistant Examiner*—Matthew R Buck
(74) *Attorney, Agent, or Firm*—Novak Druce + Quigg, LLP

(57) ABSTRACT

The present invention relates to a draghead (1) for a trailing suction hopper, comprising a visor (2), revolvable around a first axis (6) for removing soil, and a suction line (31) connected to the visor (2) for the removal of the loosened soil, characterised in that the draghead (1) is provided with a pressure plate (21), which comprises a number of mainly disc-shaped penetrating bodies (22) on the soil-facing side of the pressure plate (21), in such a way that their circumferential edge (23) is capable of transferring forces to the soil.

26 Claims, 7 Drawing Sheets

U.S. PATENT DOCUMENTS 5,732,487 A * 3/1998 Van De Kerckhove ..... 37/333
5,970,635 A * 10/1999 Wilmoth ..... 37/323
6,273,632 B1 * 8/2001 Takahashi et al. ..... 403/154
6,449,883 B1 * 9/2002 Vandycke ..... 37/323
7,089,693 B2 * 8/2006 Collins et al. ..... 37/309
2004/0148813 A1 * 8/2004 Collins et al. ..... 37/333

FOREIGN PATENT DOCUMENTS

NL 8 501 357 A 9/1986

* cited by examiner

DRAGHEAD FOR A TRAILING SUCTION HOPPER AND PROCESS FOR DREDGING BY MEANS OF THIS DRAGHEAD

The present invention relates to a draghead for a trailing suction hopper according to the preamble of claim 1. In particular the invention relates to a draghead to be connected to the dragpipe of a trailing suction hopper, containing a visor revolvable around a first axis for the loosening and the removal of soil. A suction line is connected onto the draghead for the removal of the loosened soil.

Such a draghead is for example known from EP-A-0892116. In EP-A-0892116 a draghead for a trailing suction hopper is described, comprising a structure connected on a suction line to which a visor with an open bottom side is hingingly connected. The structure is connected to the trailing suction hopper by a dragpipe. The dragpipe does not provide a rigid connection between the draghead and the trailing suction hopper, due to the inevitable changes in depth of the soil. The dragpipe therefore usually consists of a number of fragments of pipe connected to each other by cardan joints or other appropriate hinging connections. In dredging under water soils, the draghead with dragpipe and suction line is usually lowered under water in slanting direction at the rear of the trailing suction hopper, until it hits the bottom. By the sailing motion of the trailing suction hopper, the draghead is dragged over the soil to be dredged, loosening the soil and sucking the latter away to e.g. a storage facility present on the trailing suction hopper. Due to the non-rigid nature of the connection between draghead en trailing suction hopper no force can be exerted onto the draghead. The draghead is however held to the soil by the underwater weight of the underwater parts, i.e. the weight of the underwater parts reduced by the weight of the displaced water.

The known draghead mainly consists of a helmet, directly connected to a suction line of the ship, and a visor hingingly connected to the helmet by a first axis, usually, while in use, lying in a horizontal plane, and more or less parallel to the soil to be dredged. The visor usually has an upper wall and two sidewalls, and is open at the bottom. The known visor comprises a series of teeth, mounted on a beam parallel to the first axis, intended to carve the soil. For a person skilled in the art this beam is known as a teeth beam.

On the bottom side of the known helmet, near the connection to the visor, usually a series of wear heelpieces—however not compulsory for the invention—are provided, together forming the so called heel plate. It is possible that the wear heelpieces are provided with a number of nozzles.

While dredging, the draghead is moved across the soil, the soil supporting the helmet through the heel plate. Because the visor is movable, at least around the first axis, independently of the helmet, the visor usually rests on the bottom with its side and/or the, in use, downstream side of the top face. The walls will hereby more or less penetrate the soil in a way depending on the hardness of the soil. Due to the suction of the dredge pump on the side of the suction pipe, an underpressure will be built up in the draghead. By doing so, a part of the soil to be dredged, together with an amount of water, will be sucked up. In the context of this application downstream refers to the direction opposed to the sailing direction of the vessel (corresponding to the dragging direction of the draghead). Upstream refers to the sailing direction (or the dragging direction).

The known draghead however has the disadvantage that it can only be used for relatively soft soils. Indeed, if the soil gets too hard, the teeth of the draghead will not be able to sufficiently penetrate the soil under the weight of the underwater parts, on the one hand prohibiting the teeth to do their job, and on the other hand causing that insufficient soil is sucked up. For soils of which the composition consists only partially of a harder material, the efficiency of the dredging production is lowered substantially, because mainly water is sucked up. In the context of this application efficiency refers to the volume of dredged soil per time unit.

Accordingly, it is an object of the present invention to provide a draghead for a trailing suction hopper which is capable of dredging hard soils with sufficient efficiency.

To this end, the draghead according to the invention is characterised in that the draghead is provided with a pressure plate, which comprises a number of mainly disc-shaped penetrating bodies on the soil-facing side of the pressure plate, in such a way that their circumferential edge is capable of transferring forces to the soil.

By providing a pressure plate with penetrating bodies in the vicinity of the visor, it has been found according to the invention, that the hard soil in the vicinity of the draghead is effectively shattered. Because the disc surface of the disc-shaped penetrating bodies is mounted mainly perpendicular to the bottom side of the pressure plate and moreover partially protrude from the bottom side, the circumferential edge contacts the soil. The weight of the under water parts of the trailing suction hopper is thus spread over the contact surface between penetrating body and the soil. In this way, apparently sufficient pressure is created for shattering the hard soil. The thus created soil flakes can be sucked up by the suction line if required. It is surprising that the penetrating bodies are capable of shattering the hard soil, because in the shattering of such hard soils, on the usual scale of dragheads, very large forces are required.

The draghead is dragged over the soil during which it especially contacts the soil by means of the penetrating bodies. It is therefore advantageous to characterise the draghead in mounting the disc-shaped penetrating bodies rotatable around their axis, the axis being perpendicular to the surface of the disc, where the rotational axis is mainly perpendicular to the drag direction. Thus significantly less power is needed to move the trailing suction hopper forward with the usual speeds.

A further advantage of the draghead according to the invention is that in addition to the soil being shattered, shattered particles of the soil are sucked up with a good efficiency, meaning the concentration of these particles in the sucked up water is high.

Preferably the draghead is, according to the invention, characterised in that the draghead comprises a visor, revolvable around a first axis and comprising at least one pressure plate. By comprising the pressure plate in the visor, the efficiency by which shattered particles are being sucked up can be improved.

By using the underpressure present in the draghead according to the invention, surprisingly, enough soil-pressure can be realised to increase the efficiency of the draghead. By sufficiently increasing the suction surface of the draghead according to the invention, compared to what is usual, the average underpressure present in the draghead is sufficiently high to realise the necessary soil pressure. This can also be accomplished in those cases where it may be expected that there will be a relatively bad sealing between the visor and the harder soil.

It is noted that a pressure plate with penetrating bodies is known in itself. Such pressure plates are for example used in drilling tunnels in hard rocks. This known circular-shaped pressure plate with the concentrically mounted penetrating bodies is mounted on a robotic arm of a caterpillar-tracked vehicle or a different stationary structure, and rotationally moved forward. The shattered rock flakes are, in such an application, usually transported by a conveyor belt in dry condition.

It is also noted that hard under water soils can also be dredged by using a device which is known to a person skilled in the art as a cutter suction dredger. Such a cutter suction dredger comprises a ship that is anchored in the under water soil by so called spud poles, which creates a means to absorb and pass on the large reactive forces to the soil. At the other side of the ship a ladder with suction tube is guided under water in slanting direction. At the end of the ladder a construction is attached, shaped like a birdcage with bars, on which chisels are mounted. This construction is rotated relatively slowly (usually at a rotation speed of 20 or 30 rotations a minute) into the soil by which large pieces of soil are knocked off with large force by means of the chisels. Such cutter suction dredgers have the disadvantage that they can only be moved with great (financial) effort. They are in addition not manoeuvrable and can, certainly in waters that have to remain reachable like for example harbours, cause a lot of nuisance.

The draghead according to the invention is preferably characterised in that the draghead comprises a plurality of visors, revolvably mounted around the axes, each of the visors comprising at least one pressure plate, the visors, considered in the drag direction of the draghead, being consecutively mounted and forming a substantially continuous whole.

In such a preferred embodiment a higher efficiency in dredging can be reached. By providing a draghead which comprises a plurality of visors a much better contact with the soil is achieved. For the soil is usually not flat but can present different inequalities. By providing the draghead with different visors with pressure plate the penetrating bodies remain in good contact with the soil. Thus the total pressure force, executed on the soil, is well spread over the soil. Because of this, almost every penetrating body can perform its shattering action, thus increasing the volume of shattered soil per unit of time (the efficiency). In this preferred embodiment the visors are mounted consecutively, separately hinging. The visors need to form a mainly continuous whole. The whole of visors is thus connected to the suction line through the most upstream visor in the whole of the visors. By the mainly continuous whole is meant, in the context of this application, that the different visors are connected to each other so as to substantially sustain the suction force of the suction line through the entire continuous whole.

If visor, pressure plate, or penetrating bodies are mentioned in the description, in the context of this application also a plurality of visors, pressure plates, penetrating bodies have to be considered.

To ensure that on one hand a sufficient sealing between visor and soil exists and that, on the other hand dredging can occur with sufficient efficiency, the draghead according to the invention is preferably provided with a visor with pressure plate, the pressure plate being connected revolvable around a third axis to the draghead and/or the visor, the third axis extending substantially perpendicular to the drag direction. More preferably the pressure plate is connected to the draghead and/or the visor by means of a spring connection. By resiliently suspending the pressure plate, it is accomplished that the at first undulating soil is leveled after dredging. If a pressure plate with penetrating bodies is pulled over a hill the spring will be compressed, which is accompanied by the exertion of a reactive force. This reactive force, which is of course dependent on the spring constant of the spring, results in a further penetration. Upon passing a valley the spring will relax which causes the reactive forces to lessen, and thus also the penetration. A further benefit is that by resiliently suspending the pressure plate the latter is less loaded with torsion, which benefits the reliability in operation.

Most preferably the pressure plate is attached revolvable around the second and/or third axis to the draghead and/or visor on one side and on the other side by means of a spring connection. As a result the force exerted by the penetrating bodies on the soil is doubled due to the creation of a lever action.

It is further advantageous that the draghead, according to the invention, is provided with sealants, which at least partially seal the opening in between parts, like visor and pressure plate, and/or between a part, like the visor, and the soil.

By providing sealants it is accomplished that the suction force provided by the suction line strongly sucks the suction head onto the soil, thus creating an at least partial vacuum in the space delimited by the visor and/or pressure plate and/or the soil. The sucking effect causes that enough compressive stress under the penetrating bodies can be developed in the soil, so the latter breaks, flakes or otherwise collapses.

The sealing of the opening between the parts can be done by any means known to the person skilled in the art. However it is advantageous that the draghead according to the invention is characterised in that the sealants comprise a strip of flexible material, the strip spanning the opening and being attached to at least one side of the opening of the according part. If the sealants are only connected to one side of the opening to be spanned on the according part, then a material is preferably used which is rigid enough to abut a stop, located on the opposite side of the opening. This stop can be part of the wall of a part, like for example the visor. For the sealing between visor and/or pressure plate, and the soil, the stop is formed by the soil surface.

If sealants are attached to the according parts on both sides of the opening to be spanned then preferably a material is used that is flexible enough to accommodate the mutual movement of the two parts. In this embodiment it is further advantageous to provide more flexible material than strictly necessary to span the opening. When the opening is small the flexible material can be found, in such a case, in a more or less folded condition. The mutual movement of the two parts can be simply accommodated, in an enlarging opening, by stretching the folds.

By preferably implementing the draghead, according to the invention, in such a way that the pressure plate is mounted revolvable around a second axis (7) to the visor, a further improvement in efficiency can be reached. In this embodiment an increased number of penetrating bodies will remain in contact with the soil, because of which the shattering action is increased and also a better sealing between soil and pressure plate is achieved. For a good operation it is recommendable that the ground pressure per penetrating body remains between certain limits. When the ground pressure is too large the penetrating body can be damaged and when the ground pressure is too small the excavation effect is minimal. Therefore it is aimed that all the penetrating bodies of the draghead contact the soil substantially simultaneously to spread the total of the ground pressure accordingly over all the present penetrating bodies.

To further improve the efficiency of the dredging of the hard soil the draghead according to the invention is preferably characterised in that the whole of visors of the draghead seen from above forms a substantially rectangular suction surface, with a length and a width, in and perpendicular to the drag direction respectively, in which the disc-shaped penetrating bodies are positioned in such a way over the width of the suction plane that they leave a lane of 20 to 80%, preferably of 40 to 60%, of the width vacant. Preferably this is a middle lane. Also the pressure plates of the draghead are preferably constructed in such a way that they have a recessed part near the middle lane by which the middle lane less easily contacts the surface. In this way the risk that the penetrating bodies on both sides of the middle lane lose contact with the soil is further decreased.

The penetrating bodies of two consecutive visors can in principle be positioned in any way with respect to each other. To further increase the efficiency of the dredging it is however beneficiary to mount a disc-shaped penetrating body staggered with respect to the nearest, upstream penetrating body, thus having a larger operational width than a single penetrating body.

In the context of this application staggered means that, with respect to the drag direction, the different penetrating bodies are positioned inclined one after the other and/or next to each other, their disc surfaces remaining substantially parallel to the to the drag direction (i.e. the disc axes are positioned perpendicular to the drag direction). In this way it is advantageous to position all of the penetrating bodies staggered with respect to each other in such a way that they form one or more spruce-shaped patterns with the top pointing downstream and/or upstream. By positioning the penetrating bodies in such a way the realised production will be higher than the accumulated production of the separate individual bodies.

Considered in the direction of the width of the draghead or the suction plane, the disc-shaped penetrating bodies can be positioned on each desired, perhaps different, distance from each other. The mutual distance is, among other things, determined by the dimensions of the penetrating bodies and the total under water weight, next to the suction force developed by the sucking action of the suction line. Apart from that the properties of the soil are of importance, and especially the ratio compression strength/tensile strength of the soil. It is clear that an appropriate choice of the mutual distance of the penetrating bodies can be easily made by a person skilled in the art. Because of the simplicity of the construction it is advantageous to make the mutual distance between penetrating bodies adaptable per pressure plate. In this way the mutual distance between the penetrating bodies can be adapted in function of the type of soil thus optimising the production. In this way a pressure plate with damaged penetrating bodies can be easily replaced by a new undamaged one. An especially appropriate intermediate distance along the direction of the width between two consecutive penetrating bodies is between 5 and 40 cm. Most preferably between 10 and 20 cm.

Regarding the dimensions of the penetrating bodies it can be noted that they can be chosen depending on the expected pressure forces and the operational width. The diameter of the penetrating bodies can vary from a few centimetres to several decimetres. In particular appropriate diameters vary between 5 and 80 centimetres. Penetrating bodies with such diameters give evidence of a good balance between the power needed per advanced meter and the dredging efficiency to be achieved, i.e. the amount of $m^3$ dredged soil per second. More preferably the draghead according to the invention is characterised in that the diameter of the disc-shaped penetrating bodies (10) is situated between 10 and 40 cm. Such preferable diameters accomplish a deeper penetration in that same soil. Hereby a higher efficiency is reached. When the diameter of the penetrating bodies becomes too small, the penetration will indeed be improved, yet this will be at the expense of the propagation of the trailing suction hopper, which will experience a raised roll or drag resistance. Because of the raised resistance more drag power is needed.

To facilitate the dredging and in particular the sucking up of the shattered soil pieces the draghead can be provided, if desired, with at least one series of teeth extending perpendicular to the drag direction. Preferably this series of teeth is located on the visor and/or the pressure plate right in front of each penetrating body. The positioning of the series of teeth in relation to the other parts of the draghead according to the invention, can be chosen in function of the specific conditions of the soil to be dredged. It is therefore possible to position the series of teeth upstream and/or downstream of the penetrating bodies. In case the series of teeth are positioned upstream to the penetrating bodies, the teeth will ensure that any possible perturbations present in and/or on the hard soil, like for example clay and/or sand, are removed in advance and/or thus allowing the penetrating bodies to perform their duties in the hard soil.

If desired the draghead according to the invention can be provided with at least one series of jet nozzles for injecting water, preferably under high pressure. The application of jet nozzles for the injection of water, preferably under high pressure, itself is known for dredging soft and loosely packed soils as for example sand soil. The efficiency of the dredging in such soils on one hand is determined by the teeth present on the visor, by which, through passing of the draghead over the soil, a peal of soil is cut off. The soil cut off in this way can then be sucked up. The known draghead can also comprise jet nozzles for injecting water under high pressure, for example in the wear heelpieces. Usual pressures lie for example between 10 or 200 bar, but pressures up to 2500 bar are also possible. These make it possible to suck up extra sand, since the soil to be dredged consists of stacked grains, which are pushed on each other due to their own weight. This packing balance is disturbed by addition of water under high pressure, by which the sand is fluidised, that therefore can be sucked up more easily.

It is surprising that the use of jet nozzles in the draghead according to the invention, is advantageous to the dredging efficiency when the draghead is used for hard soils.

The jet nozzles can, according to the invention, be mounted upstream and/or downstream and/or near the pressure plate with the penetrating bodies. In a downstream mount the fluid, injected in the at least already partly shattered soil under high pressure e.g. 2000 bar, will cooperate in evacuating the soil flakes through the suction line, and/or in further reducing the size and/or in fluidising the already broken parts of soil. In an upstream mount the fluid injected in the already partly shattered soil under high pressure, will cooperate in removing softer ground layers of the soil, thus better defining the soil surface, onto which the penetrating bodies can improvably adhere. In a mount near the pressure plate comprising the penetrating bodies the fluid is injected under high pressure in the, if necessary, not yet shattered hard soil beneath a penetrating body. Hereby the fluid penetrates the already partly formed cracks and will therefore accelerate the shattering of the soil. Because the jets evacuate the shattered soil particles the wear of the penetrating bodies will also decrease.

The position of the pressure solid comprising the penetrating bodies or the plurality of pressure solids in relation to the visor can be arbitrarily chosen. Thus it is possible that the pressure solid, in relation to the drag direction of the draghead in use, is before (upstream of) the visor. In that case the pressure solid can be mounted on a connecting pipe therefor provided. The material shattered by the pressure solid is sucked up when the visor passes.

The invention also relates to a process for the breaking up and/or dredging of at least partially hard under water soils with a trailing suction hopper, provided with a draghead according to the invention.

Other details and advantages of the device according to the invention will become apparent from the enclosed figures and description of preferred embodiments of the invention, without limiting the invention thereto. The reference numbers relate to the appended figures.

Figure 3:
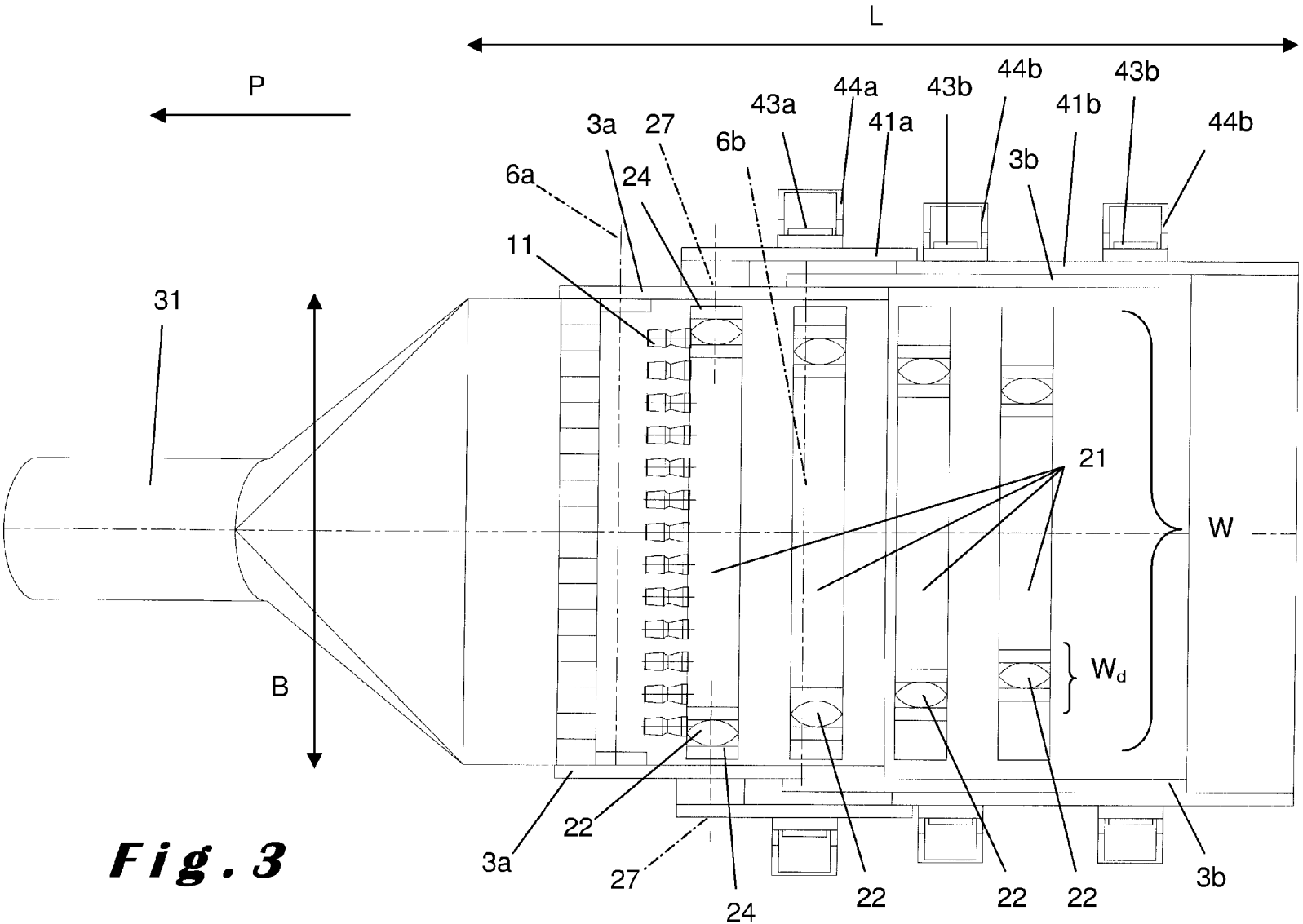

FIG. 3 schematically shows a bottom view of the draghead according to the invention and schematically illustrates a suction surface delimited by a plurality of visors, and a preferred placement of the penetrating bodies.

Figure 4A:
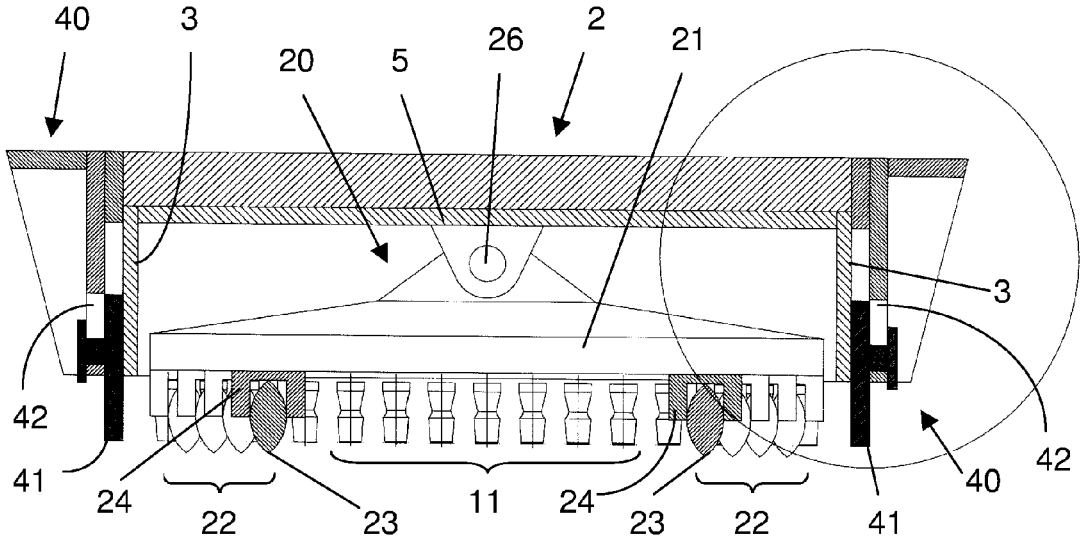

FIG. 4*a* shows in rear view a cross-section, along the line 6*b*, of the draghead of FIG. 3.

Figure 1:
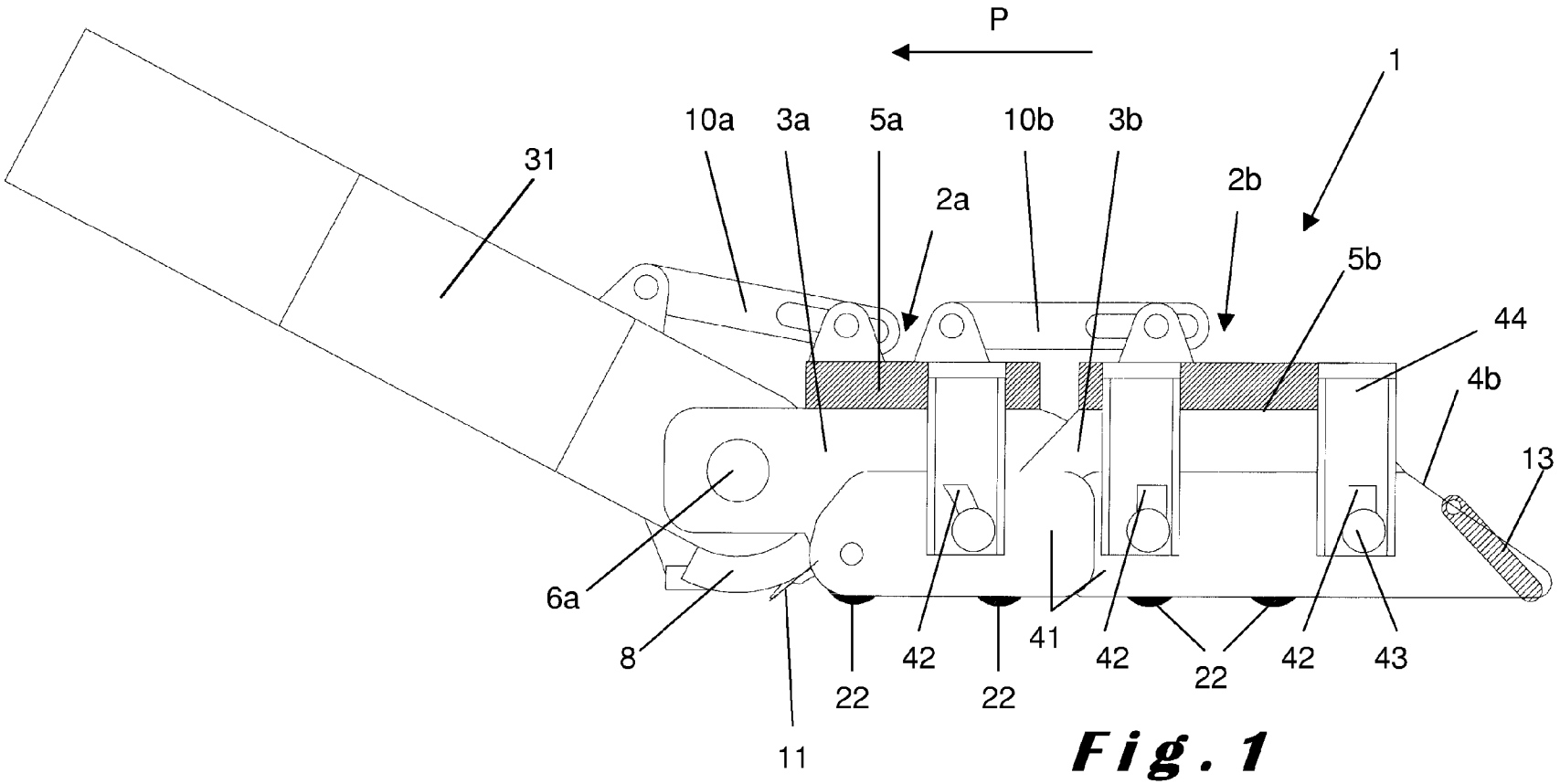
FIG. 1 shows a schematic side view of a draghead according to the invention.
Figure 2:
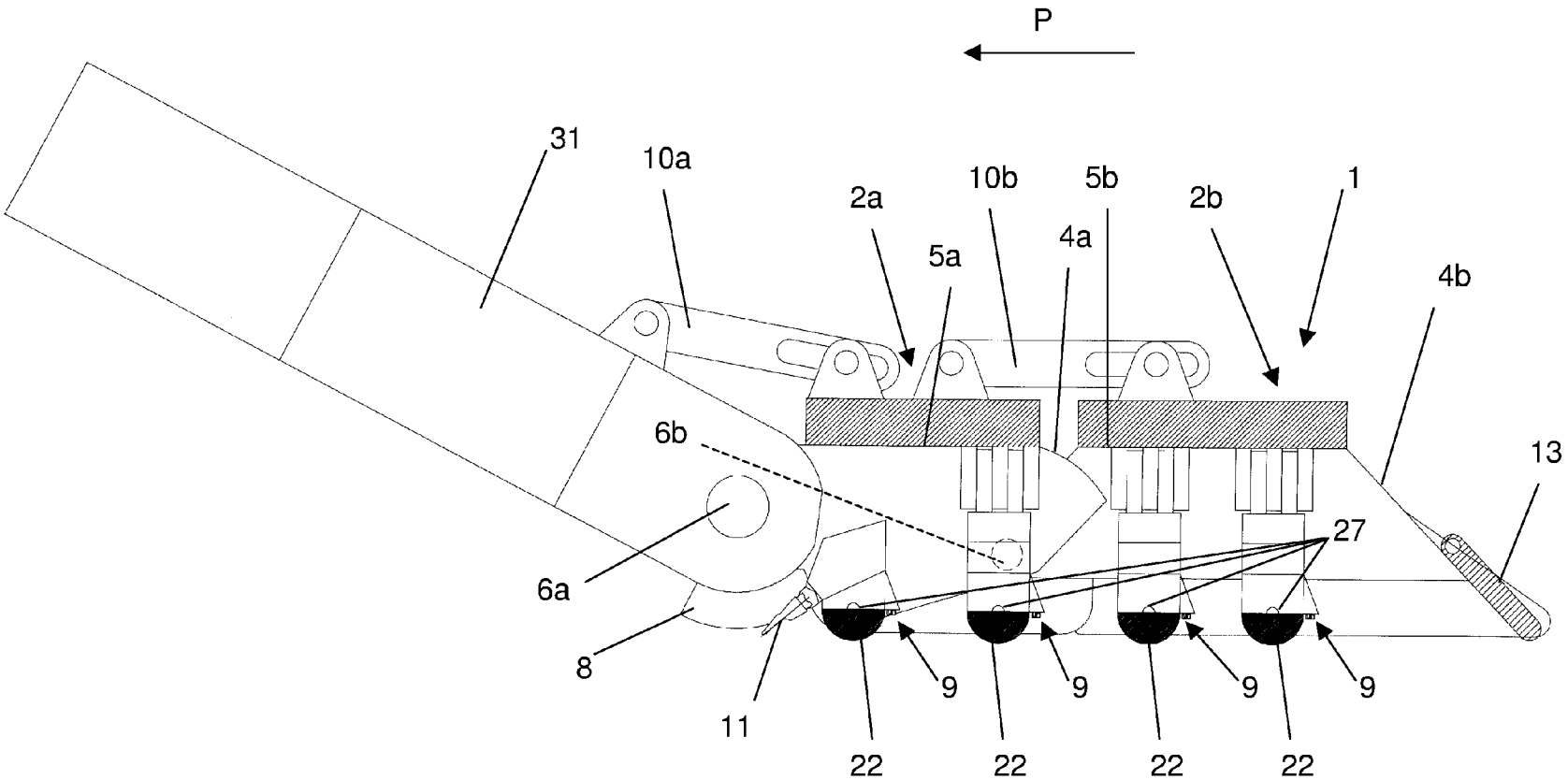
FIG. 2 shows a schematic reproduction of a longitudinal section of the draghead according to FIG. 1.
Figure 4B:
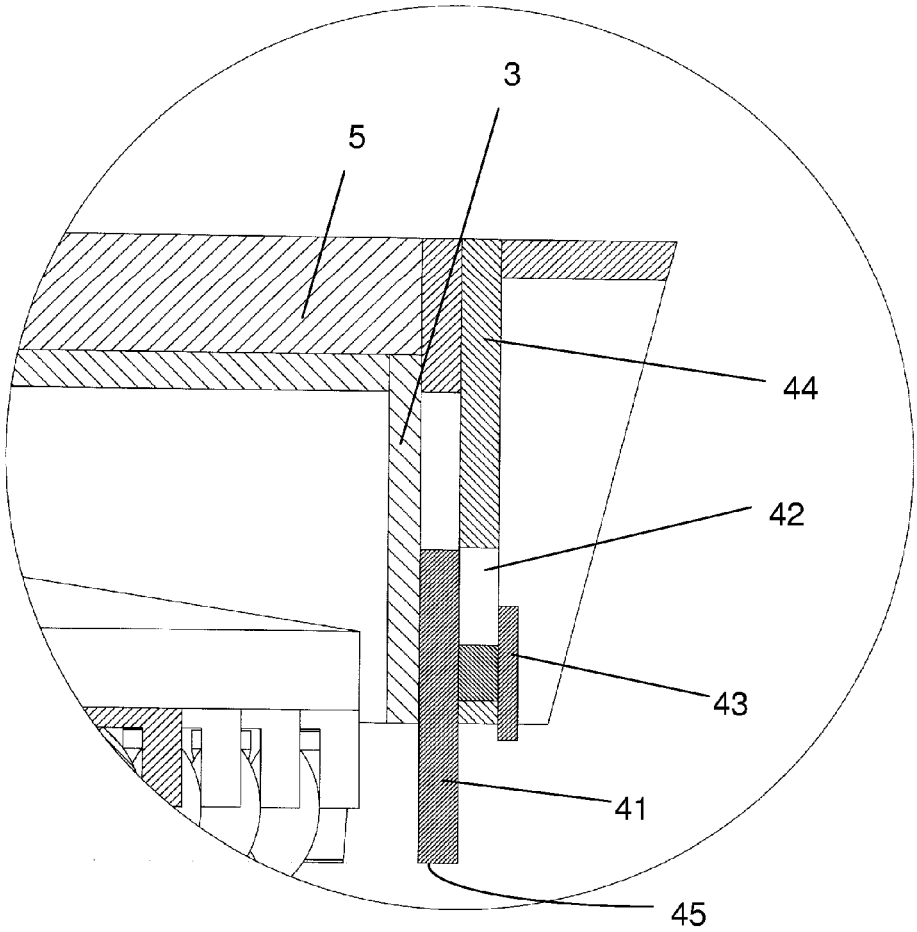

FIG. 4*b* shows in rear view a detail of the sealants of the draghead of FIG. 1.

Figure 5:
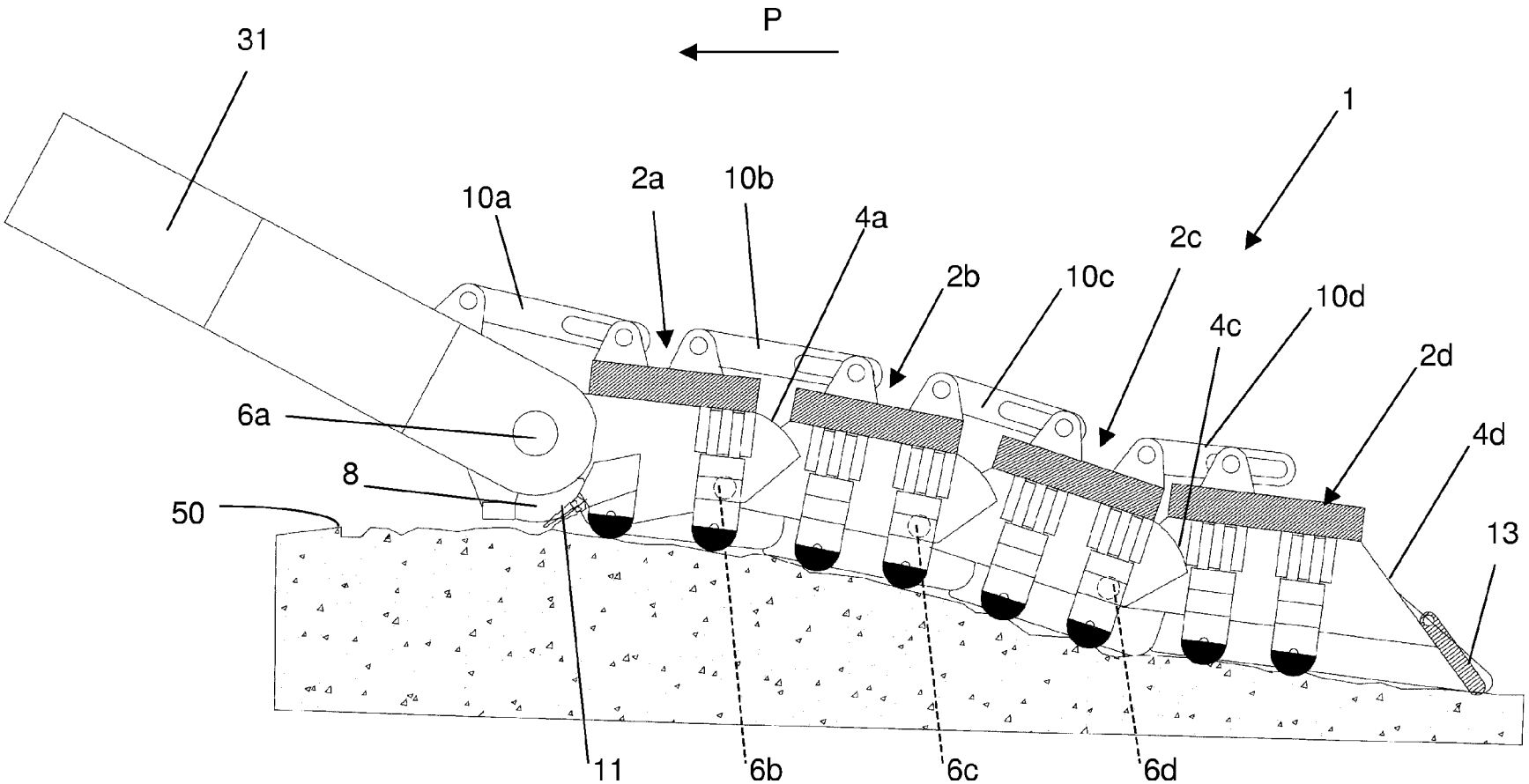

FIG. 5 schematically shows a longitudinal section of a draghead according to the invention on a hard surface.

Figure 6:
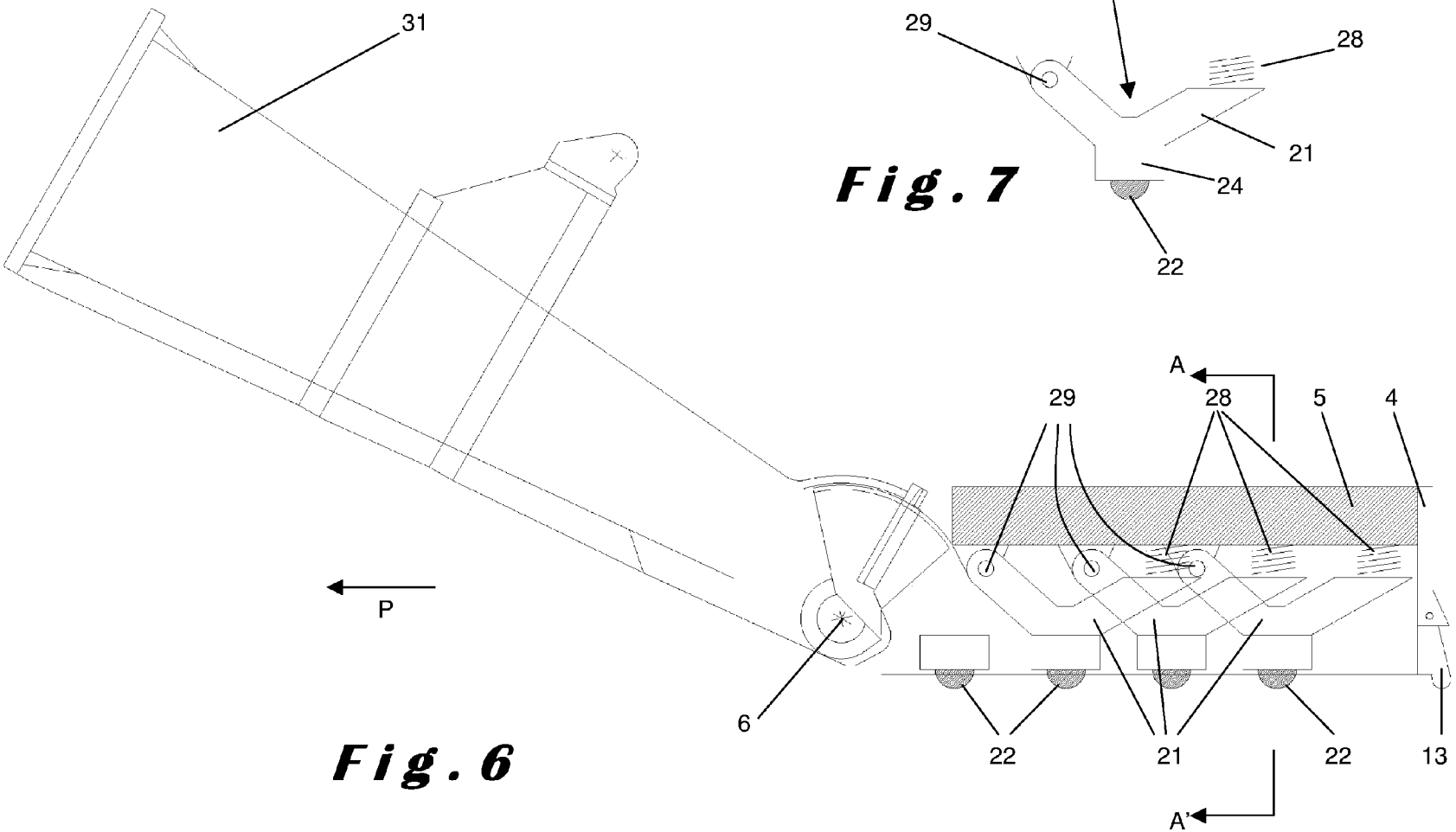

FIG. 6 shows a schematic reproduction of a longitudinal cut of the draghead according to the invention with one visor.

Figure 7:
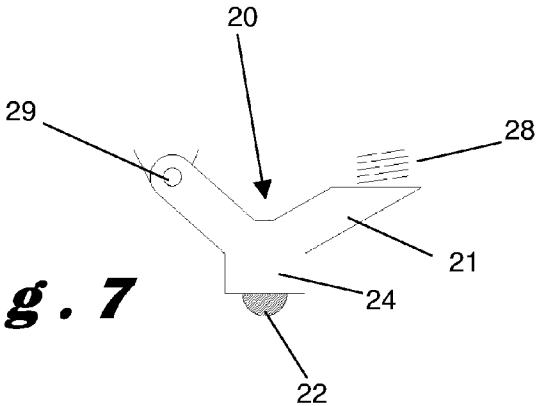

FIG. 7 schematically shows in a side view a detail of a pressure plate comprising penetrating bodies.

Figure 8:
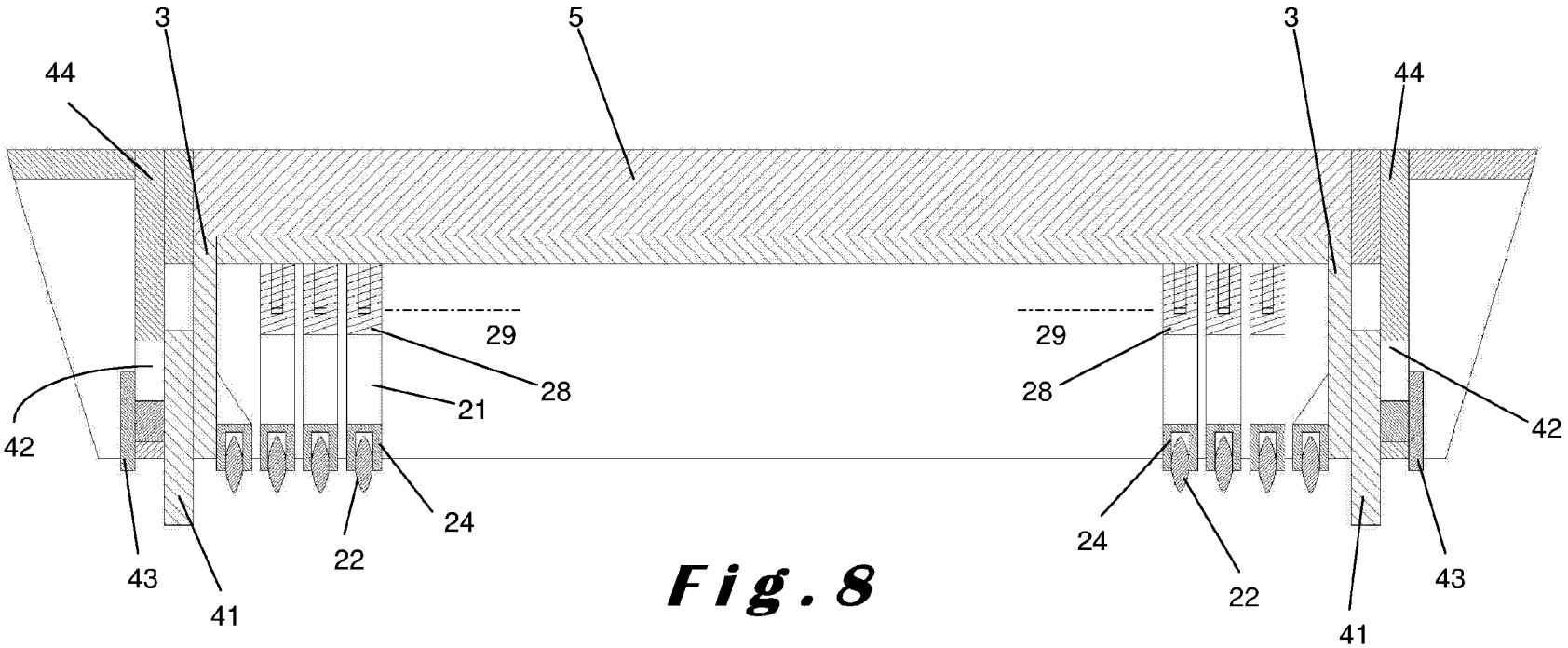

FIG. 8 finally shows in a rear view a cross-section along the line A-A' of the draghead of FIG. 6.

The draghead 1 for a trailing suction hopper according to the invention is in use moved over the soil surface 50 in the direction of arrow P. The draghead 1 according to the invention is mounted at the end of the suction line 31 and is connected thereto. In a first embodiment, the draghead 1 is provided with different mutually connected visors 2*a*, 2*b*, 2*c*, . . . , as shown in FIG. 1. Each visor 2*a*, 2*b*, 2*c*, . . . comprises at least side walls 3 (3*a*, 3*b*, 3*c*, . . . ), a rear wall 4 (4*a*, 4*b*, 4*c*, . . . ), an upper plate 5 (5*a*, 5*b*, 5*c*, . . . ) with possibly an arched part, which remains in close contact, while the visor revolves around its axis 6 (6*a*, 6*b*, 6*c*, . . . ), with a sealing strip connected to the rear wall 4, for example a rubber strip, being part of the fixed parts being mounted on the draghead 1. During dredging, an underpressure is maintained in the draghead 1 to be able to suck up the loosened hard soil particles and other soil particles through the suction line 31. According to the invention the hard soil 50 is shattered and loosened by the action of the pressure solid 20 (as shown in FIG. 4*a*) which can be located upstream and/or downstream and/or in the interior of the visor 2. Preferably the pressure solid 20 comprises a pressure plate 21, contained in each of the visors 2*a*, 2*b*, 2*c*, . . . , hingingly connected around a second axis 26 to the visor 2. The rotation axis 26 in this embodiment is mainly parallel to the drag direction P. In the pressure plate 21 a number of disc-shaped penetrating bodies 22 are included. The penetrating bodies 22 are disc-shaped, the disc surface (perpendicular to the disc axis 27) being substantially parallel to the drag direction P. The penetrating bodies 22 are preferably circular and are supported, with a small part of their circumferential edge 23, on the bottom 50. In order to keep the roll resistance over the soil 50 as low as possible, the penetrating bodies are suspended by hinges 24 in and/or to the pressure plate 21, so they can rotate around their axis 27. The whole of mutually connected visors 2*a*, 2*b*, 2*c*, . . . is, if desired, provided on the upstream bottom surface of a heel plate 8. The heel plate 8 on one hand ensures enough support for the draghead 1 on the bottom 50, and on the other hand ensures a sufficient sealant against possible suction of water on the upstream side. The draghead 1 according to the invention has the advantage that the heel plate 8 can be omitted. In such an embodiment, its function is taken over by the penetrating bodies 22 of the most upstream pressure solid 20, which is preferably rigidly connected to the draghead. It is preferable that the draghead is provided with a number of jet nozzles 9 which can inject water, possibly under high pressure, into the soil. The necessary waterlines needed for this can be supplied along the suction line. During the dragging of the draghead over the soil the penetrating bodies 22 will develop a large pressure on the hard soil 50 in which the latter is at least partially shattered near the contact surface between penetrating body 22 and the soil 50. Preferably each visor 2*a*, 2*b*, 2*c*, . . . is hereby pressed onto the soil. This is accomplished by mounting the visors hingingly around their axes 6. Control bars 10*a*, 10*b*, 10*c*, . . . can be provided to limit the angular deviation of a first visor in relation to a second visor, directly connected thereto, as shown in FIG. 5. The injected water jets, preferably directed to that bottom part that is situated directly under a penetrating body, can help to turn up sand or sedimented hard ground parts, which then can also be sucked up more easily. At the same time the teeth 11, which are, if desired, mounted on a part of the visors 2 and occur for example behind the jet nozzles 9, will cut loose sand or other soil materials. Behind these teeth 11, or in stead of these teeth 11, if desired, a second series of jet nozzles 9 can be provided near the rear wall which closes the visor 2 at the rear end. The second series of jet nozzles can be subdivided in a first series of jet nozzles, pointing to the teeth 11 and/or the penetrating bodies and a second series of jet nozzles which are directed vertically or nearly vertically downwards. The jets injected by the jet nozzles are for example pointing to the inside of the visor. The jet nozzles are intended to better fluidise the soil, i.e. deeper, near the rear wall and to further shatter and loosen the partly loosened hard soil.

The penetration of the penetrating bodies 22 in the hard soil material 50 can occur on any desired depth, depending on the sizes of the penetrating bodies 20, the supplied power, the specific properties of the soil 50, and so on. It is possible to provide means to adjust the depth of the penetration. In this way it is for example possible that the pressure plate 21 with the different penetrating bodies 22 is connected immediately to the rear wall which can be replaced, in particular along a translation located in a plane situated parallel to the rear wall 4 of the visor. In case of a hydraulic operation this height adjustment takes place on the bridge of the trailing suction hopper. The in height adjustable mounting of the rear wall 4 and/or the penetrating bodies 22 thus raises the efficiency of the new draghead 1, because the penetrating depth can be optimally adjusted in function of the properties of the soil and totally independent of the penetration of the visor in the soil.

Another embodiment of the draghead according to the invention is shown in FIG. 6. Instead of providing the visor with multiple, mutually connected visors, each with their own pressure plate (note that according to the invention it is not necessary to provide each visor with a pressure plate), in this embodiment only one visor 1 is used, in which at least one pressure solid 20 (FIG. 7) with penetrating bodies 22 is contained. The visor is again provided with sealants, as already mentioned above for a draghead with multiple visors, and shown in FIG. 8. By providing one visor, if desired with a large length (for example a few meters), a better sealing from the soil surface and from the surrounding water is obtained, which benefits the efficiency of the dredging.

To ensure a sufficient sealing between visor and soil and otherwise ensure a sufficient efficiency in dredging, the draghead 1 according to this embodiment is provided with a visor 2 with pressure plate 21, in which the pressure plate 21 is mounted revolvable around a third axis 29 to the draghead 1 and/or the visor 2, in which the third axis 29 extends substantially perpendicular to the drag direction P.

In mounting the pressure plate 21 revolvable round an axis 29, the penetrating bodies 22 are more capable of following the profile of the soil. Obviously the mutual distance between hinging points 26 and/or 29 of two consecutive pressure plates 21 can be chosen in a wide interval, the choice depending on, among other things, the soil. A further improved embodiment has pressure plates 21 which can be connected to the draghead 1 and/or the visor 2 through a spring connection 28. Such a spring connection 28 is easily realised by a person skilled in the art and is preferably executed in such a way that the pressure plate 21 with penetrating bodies 22 can perform a translation substantially perpendicular to the soil surface 50. By resiliently suspending the pressure plate it is accomplished that the at first undulating soil 50 is leveled after dredging. If a pressure plate 21 with penetrating bodies 22 is pulled over a hill the spring 28 will be compressed which involves an increase of the reactive force on the soil. This increased reactive force, which is of course dependent on the spring constant of the spring, results in a further penetration of the penetrating bodies 22 in the soil. Upon passing a valley, the spring 28 will relax which causes the reactive forces to lessen, thus also decreasing the penetration. A further benefit is that by resiliently suspending the pressure solid 20, the latter is less loaded with torsion by inequalities of the soil, which benefits the reliability of the draghead. By the shock absorbing action the penetrating bodies 22 will also experience less damage.

The spring connection 28 can be executed in all possible ways available to a person skilled in the art. Thus it is possible to use mechanic, hydraulic and/or pneumatic spring systems. These have the advantage that the spring constant can be adjusted, according to the condition and the properties of the soil.

As shown in FIGS. 6 and 7 the pressure plate 21 is on one side, if desired, mounted revolvable around the second axis 26 and/or the third axis 29 with the draghead 1 and/or visor 2, and to the other side by a spring connection 28. In FIG. 6 an embodiment is shown in which the upstream side of the pressure plate 21 is connected revolvable round a third axis 29 to the visor 2. The downstream side is connected to the visor 2 by a spring connection 28. By consecutively providing the penetrating bodies 22 in the pressure plate 21 on a place located between the two connection points (axis 29 and spring 28) a lever action is obtained. Because of the lever action, the force exerted by spring 28 has to be only a fraction of the required ground pressure which has to be exerted by the penetrating body.

Of course, also in the embodiment with only one visor, teeth, jet nozzles and such can be used if desired, as described above for an embodiment with a plurality of connected visors.

In order to prevent that supply water is supplied through the relatively unproductive sides of the visor 2, the draghead is preferably well sealed on these locations. Preferably the side walls 3 and 4 of the visor are well sealed. When using the draghead according to the invention on hard soils this penetration is hindered.

Therefore the draghead is preferably provided with sealants 40. By providing the sealants 40 it is accomplished that the suction force originating from the suction line 31 will suck the draghead 1 strongly onto the soil 50, thus creating an at least partial vacuum in the space delimited by the visor 2 and/or the pressure plate 21 and/or the soil 50. This suction action ensures that enough compressive stress under the penetrating bodies 22 can be developed in the soil 50, so the latter breaks, flakes or otherwise collapses. By providing, according to the invention, a number of connected visors 2*a*, 2*b*, 2*c*, . . . this compressive stress is further increased.

In case of the preferred embodiment of the draghead shown in the figures, sealants 40 comprise a closing plate 41, which is received slideably in height, in a height adjustment groove 42 and is contained herein by means of a flange 43. Groove 42 is applied in suspension plate 44, which is connected to the visor 2. The dimensions are chosen such that the closing plates 41 can set on the soil 50, in which occasional level differences can be absorbed in a translation of the closing plate 41 in the groove 42. The sealing can be improved, if desired, by increasing the weight of the closing plates 41. Preferably the bottom edge 45 of the closing plate 41 is relatively flat. A suitable thickness of the bottom edge 45 is for example situated between 5 and 20 cm. If desired the bottom edge is provided with a rubber coating.

To be able to adjust the underpressure in the interior of the draghead 1, the latter can be provided with a hingable regulating valve 13 which can at least partially close the rear end 4. If the underpressure becomes too high, so that the draghead is difficult to drag or the penetrating bodies 22 experience a too great a risk of getting damaged, water from outside the draghead 1 can be allowed in by opening the regulating valve 13, so that the underpressure at least partially drops. Preferably the regulating valve 13 is placed in the most downstream rear end 4. The regulating valve 13 can be adjusted from the ship or, if desired, by means of an automatic underpressure measurement in the visor 2.

Pressure solid 20 is preferably mounted revolvably around a rotation axis 26. The pressure solid 20 comprises a pressure plate 21, in which and/or on which a number of penetrating bodies 22 are mounted. These are revolvable around an axis 27 and are comprised in hinge joint pieces 24. The penetrating bodies 22 press by means of their circumferential edge 23 on the soil beneath, by which this is shattered. The required compressive force is supplied by the total under water weight of the draghead 1 and suction line 31, and by the suction force produced by the draghead according to the invention.

In the advantageous case that the draghead according to the invention is provided with a number of pressure solids 22, these are preferably mounted such with respect to each other that a larger operational width W can be covered than the operational width $W_d$ of a single pressure solid 22. This can be accomplished by mounting the penetrating bodies 22 in formation, in which a second series of penetrating bodies 22 is positioned upstream of a first series of penetrating bodies 22, comprising a series of adjacently mounted penetrating bodies 22, the total width of the second series being larger than the total width of the first series. Preferably the penetrating bodies 22 are staggered in such a way that the desired operational width W more or less corresponds with the total width of the draghead, without 'creating gaps in it'. In staggering the penetrating bodies with a mutual distance which is adjusted in function of the sort of soil the realised production is higher than the cumulated production of all the separate penetrating bodies.

It is further advantageous that at least two penetrating bodies 22 are consecutively mounted one after the other in the drag direction P, in which the last penetrating body (the in use most downstream positioned pressure solid) has an equal or greater operational depth than the penetrating body in front of it. In this way a great operational depth can be simply and progressively reached. In addition, wear of the penetrating bodies is reduced.

By the combination of the different improvements to a draghead of the known type, a surprisingly high increase of the efficiency of the new draghead can be expected.

The invention is not limited to the embodiments discussed here and changes can be made to them without departing from the scope of the appended claims.

What is claimed is:

1. Draghead for a trailing suction hopper, comprising a visor revolvable around a first axis for removing soil, and a suction line connected to the visor for the removal of the soil loosened by the visor, wherein the draghead comprises at least one pressure plate and a number of mainly disc-shaped penetrating bodies mounted on the pressure plate, in such a way that their circumferential edge protrudes downwardly from the pressure plate and capable of transferring forces to the soil, and wherein the pressure plate transfers most of the underwater weight of the draghead to the disc-shaped penetrating bodies and wherein the pressure plate is revolvably mounted around a second axis to the draghead or the visor, the second axis extending substantially parallel with the drag direction.

2. Draghead according to claim 1, wherein the draghead (1) comprises the visor (2), which is revolvable about the first axis (6), and operably connected to at least one pressure plate (21).

3. Draghead according to claim 1, wherein the draghead (1) comprises a plurality of the visors (2*a*, 2*b*, 2*c*, . . . ), revolvably mounted around the first axes (6*a*, 6*b*, 6*c*, . . . ), each of the visors comprising at least one pressure plate (21), the visors (2*a*, 2*b*, 2*c*, . . . ), considered in the drag direction of the draghead, being consecutively mounted and forming a substantially continuous whole.

4. Draghead according to claim 1, wherein the pressure plate (21) is connected to the draghead (1) or the visor (2) in such a way that it is revolvable around a third axis (29), the third axis extending substantially perpendicular to the drag direction (P).

5. Draghead according to claim 1, wherein the pressure plate (21) is connected to the draghead (1) or the visor (2) by means of a spring connection (28).

6. Draghead according to claim 1, wherein the draghead (1) is provided with sealants (40), for at least partially sealing the mutual opening between parts.

7. Draghead according to claim 6, wherein the sealants (2) comprise a closing plate (41), which is slideably received in height direction, in a height adjustment groove (42) and is contained herein by means of a flange (43), the groove being applied in a suspension plate (44), connected to the visor (2).

8. Draghead according to claim 1, wherein the visor (2) forms a substantially rectangular suction surface, with a length (L) and a width (B), in and perpendicular to the drag direction (P) respectively, in which the disc-shaped penetrating bodies (22) are positioned in such a way along the width (B) of the suction plane that they leave a middle lane of the width (B) vacant.

9. Draghead according to claim 8, wherein a distance in width direction (B) between any two consecutive penetrating bodies is adaptable.

10. Draghead according to claim 9, wherein the distance in width direction (B) between any two consecutive penetrating bodies is between 5 and 40 centimeters and preferably between 10 and 20 centimeters.

11. Draghead according to claim 1, wherein the visor (2) forms a substantially rectangular suction surface, with a length (L) and a width (B), in and perpendicular to the drag direction (P) respectively, the disc-shaped penetrating bodies (22) mounted in a staggered position in relation to the closest upstream penetrating body (22).

12. Draghead according to claim 11, wherein a distance in width direction (B) between any two consecutive penetrating bodies is adaptable.

13. Draghead according to claim 12, wherein the distance in width direction (B) between any two consecutive penetrating bodies is between 5 and 40 centimeters and preferably between 10 and 20 centimeters.

14. Draghead according to claim 1, wherein the visor (2) forms a substantially rectangular suction surface, with a length (L) and a width (B), in and perpendicular to the drag direction (P) respectively, in which the disc-shaped penetrating bodies (22) are mounted in a staggered position in relation to each other, in such a way that at least one spruce-shaped pattern is formed.

15. Draghead according to claim 14, wherein a distance in width direction (B) between any two consecutive penetrating bodies is adaptable.

16. Draghead according to claim 15, wherein the distance in width direction (B) between any two consecutive penetrating bodies is between 5 and 40 centimeters and preferably between 10 and 20 centimeters.

17. Draghead according to claim 1, wherein a diameter of the disc-shaped penetrating bodies (22) is between 5 and 80 centimeters.

18. Draghead according to claim 1, wherein a diameter of the disc-shaped penetrating bodies (22) is between 10 and 40 centimeters.

19. Draghead according to claim 1, wherein the visor (2) is provided with a series of teeth (11) extending perpendicular to the drag direction, the teeth being located upstream from the pressure plate (21).

20. Draghead according to claim 1, wherein the draghead comprises at least one series of jet nozzles (9) for the injection of water under high pressure.

21. Draghead for a trailing suction hopper, comprising a visor revolvable around a first axis for removing soil, and a suction line connected to the visor for the removal of the soil loosened by the visor, wherein the draghead is provided with a pressure plate and a number of mainly disc-shaped penetrating bodies mounted on the pressure plate, in such a way that their circumferential edge protrudes downwardly from the pressure plate and capable of transferring forces to the soil, and wherein the pressure plate transfers most of the underwater weight of the draghead to the disc-shaped penetrating bodies, wherein the draghead is provided with sealants, for at least partially sealing the mutual opening between parts, and wherein the sealants comprise a closing plate, which is slideably received in height direction, in a height adjustment groove and is contained herein by means of a flange, the groove being applied in a suspension plate, connected to the visor.

22. Draghead according to claim 21, wherein the pressure plate (21) is revolvably mounted around a second axis (26) to the draghead (1) or the visor (2), the second axis (26) extending substantially parallel with the drag direction (P).

23. Method for the breaking or dredging of at least partially hard under water soils with a trailing suction hopper, equipped with a draghead comprising a visor revolvable around a first axis for removing soil, and a suction line connected to the visor for the removal of the loosened soil, wherein the draghead is provided with a pressure plate, which comprises a number of mainly disc-shaped penetrating bodies on the soil-facing side of the pressure plate, in such a way that their circumferential edge is capable of transferring forces to the soil, and wherein the pressure plate is revolvably mounted around a second axis to the draghead or the visor, the second axis extending substantially parallel with the drag direction, the method comprising the steps of lowering the draghead to a position on top of the soil surface and dragging it thereover while the disc-shaped penetrating bodies are at least partially contacting the soil surface, creating by means of the suction line an at least partial vacuum in the at least partially by sealants sealed space enclosed by visor, pressure plate and the soil, so that the disc-shaped penetrating bodies penetrate the soil and cause cracks therein, at least partially sucking up flakes broken off from the soil by means of the suction line and transferring via the pressure plate most of the underwater weight of the draghead to the disc-shaped penetrating bodies.

24. Method according to claim 23, wherein the visor (2) is provided with a series of teeth (11) extending perpendicular to the drag direction, which teeth at least partially penetrate the soil during the dragging.

25. Method according to claim 23, further comprising the step of injecting water under high pressure in the soils by means of at least one series of jet nozzles (9).

26. Method for the breaking or dredging of at least partially hard under water soils with a trailing suction hopper, equipped with a draghead comprising a visor revolvable around a first axis for removing soil, and a suction line connected to the visor for the removal of the loosened soil, wherein the draghead is provided with a pressure plate, which comprises a number of mainly disc-shaped penetrating bodies on the soil-facing side of the pressure plate, in such a way that their circumferential edge is capable of transferring forces to the soil, and wherein the draghead is provided with sealants for at least partially sealing the mutual opening between parts, such as visor and pressure plate, or between a part, such as the visor, and the soil, and wherein the sealants comprise a closing plate, which is slideably received in height direction, in a height adjustment groove and is contained herein by means of a flange, the groove being applied in a suspension plate, connected to the visor, the method comprising the steps of lowering the draghead to a position on top of the soil surface and dragging it thereover while the disc-shaped penetrating bodies are at least partially contacting the soil surface, creating by means of the suction line an at least partial vacuum in the at least partially by sealants sealed space enclosed by visor, pressure plate and the soil, so that the disc-shaped penetrating bodies penetrate the soil and cause cracks therein, at least partially sucking up flakes broken off from the soil by means of the suction line and transferring via the pressure plate most of the underwater weight of the draghead to the disc-shaped penetrating bodies.

* * * * *